US011220411B2

(12) United States Patent
Willingham

(10) Patent No.: US 11,220,411 B2
(45) Date of Patent: Jan. 11, 2022

(54) COILER WITH ACCOMPANYING ATTACHMENTS AND BAG

(71) Applicant: Daniel C. Willingham, Saint Louis, MO (US)

(72) Inventor: Daniel C. Willingham, Saint Louis, MO (US)

(73) Assignee: Coil Pro, LLC, St. Louis, MO (US)

( * ) Notice: Subject to any disclaimer, the term of this patent is extended or adjusted under 35 U.S.C. 154(b) by 95 days.

(21) Appl. No.: 16/794,152

(22) Filed: Feb. 18, 2020

(65) Prior Publication Data

US 2021/0253391 A1 Aug. 19, 2021

(51) Int. Cl.

| | |
|---|---|
| ***B65H 54/10*** | (2006.01) |
| ***A45F 3/04*** | (2006.01) |
| ***B65H 75/22*** | (2006.01) |
| ***B65H 75/44*** | (2006.01) |
| *A45F 3/00* | (2006.01) |

(52) U.S. Cl.

CPC ..... *B65H 54/106* (2013.01); *A45F 3/04* (2013.01); *A45F 2003/003* (2013.01); *A45F 2200/0583* (2013.01); *B65H 75/2209* (2021.05); *B65H 75/4465* (2013.01); *B65H 2701/35* (2013.01)

(58) Field of Classification Search

CPC .... B65H 75/4465; B65H 75/40; B65H 75/42; B65H 75/425; B65H 75/22; B65H 75/2206; B65H 54/106; B65H 2701/34; B65H 2701/35; A45F 2003/003; A47G 25/065; A47G 25/0635

See application file for complete search history.

(56) References Cited

U.S. PATENT DOCUMENTS

| | | | | | |
|---|---|---|---|---|---|
| 325,551 | A * | 9/1885 | Lukens | A01N 1/00 | 27/13 |
| 473,919 | A * | 5/1892 | Edsall | F16M 11/10 | 248/292.12 |
| 3,770,234 | A * | 11/1973 | Fovall | D06F 81/003 | 248/117.7 |
| 3,941,250 | A * | 3/1976 | Ott | A47G 25/0685 | 211/1.3 |
| 4,941,603 | A * | 7/1990 | Creamer | A45F 3/04 | 150/109 |
| 5,421,457 | A * | 6/1995 | Listenberger | B65D 85/04 | 174/50 |
| 5,439,109 | A * | 8/1995 | McBride | A45C 7/0077 | 174/135 |
| 5,513,816 | A * | 5/1996 | Grubb | B63B 21/04 | 114/254 |
| 5,566,843 | A * | 10/1996 | Kruska | A47G 25/065 | 211/1.3 |
| 5,868,219 | A * | 2/1999 | Sadeck | A62B 1/20 | 182/70 |
| 5,881,436 | A * | 3/1999 | Lyons | F16L 3/233 | 24/16 R |
| 5,979,816 | A * | 11/1999 | Blankenship | B63B 21/04 | 114/218 |
| 6,290,422 | B1 * | 9/2001 | Hamm | A47L 9/26 | 15/410 |

(Continued)

*Primary Examiner* — Justin M Larson

(57) ABSTRACT

A bag on which a coiler may attach. A coiling device that allows for attachments to be affixed to it, whether or not the coiler is attached to a bag. Attachments comprising a brush clip comprising a quickdraw setter/remover, brush, and other useful items.

20 Claims, 15 Drawing Sheets

(56) References Cited

U.S. PATENT DOCUMENTS 6,510,583 B2 * 1/2003 Griffin ..... A47L 9/26 15/323
6,601,743 B2 * 8/2003 Godshaw ..... A45C 9/00 190/113
6,719,259 B2 * 4/2004 Huang ..... A47B 96/061 248/441.1
6,834,670 B2 * 12/2004 Rosine ..... B65H 75/22 137/355.26
6,942,173 B1 * 9/2005 Abramov ..... B65H 75/4476 191/12 R
7,040,589 B2 * 5/2006 Wang ..... A47G 25/0685 248/242
7,575,188 B2 * 8/2009 Mullen ..... B65H 75/40 137/355.26
7,861,903 B2 * 1/2011 Plaschka ..... B60R 9/06 224/402
7,963,370 B2 * 6/2011 Hwang ..... A62B 1/10 182/240
8,132,302 B2 * 3/2012 Wilkinson ..... B65H 75/366 24/302
8,317,152 B1 * 11/2012 Zhou ..... F16M 11/041 248/596
8,523,098 B2 * 9/2013 Detweiler ..... B65H 75/28 242/404.3
8,556,313 B2 * 10/2013 Miller ..... A62B 1/18 294/82.1
8,567,739 B2 * 10/2013 Zhou ..... F16M 13/00 248/397
8,863,898 B2 * 10/2014 Harris, Jr. ..... A62B 35/0093 182/3
9,145,279 B2 * 9/2015 Miller ..... A62B 1/18
9,168,400 B2 * 10/2015 Schubert ..... A62B 1/06
9,854,897 B1 * 1/2018 Pelkey, Jr. ..... A45F 3/04
10,000,359 B2 * 6/2018 Dam ..... B65H 75/22
10,000,360 B2 * 6/2018 Stanton ..... B65H 75/4476
10,111,514 B2 * 10/2018 King ..... A45F 3/02
10,154,713 B2 * 12/2018 Willingham ..... A46B 5/00
2001/0022331 A1 * 9/2001 Smith ..... B65H 75/4473 242/404
2002/0038811 A1 * 4/2002 Vigny ..... A45F 3/04 224/651
2003/0205601 A1 * 11/2003 Kilduff ..... A45C 13/00 224/627
2006/0144885 A1 * 7/2006 Smeuninx ..... A45F 3/047 224/629
2006/0151534 A1 * 7/2006 Mares ..... A45F 3/20 222/175
2008/0041905 A1 * 2/2008 Cavett ..... A45C 13/30 224/580
2009/0184143 A1 * 7/2009 Witt ..... A45C 7/0086 224/153
2009/0302148 A1 * 12/2009 Auclair ..... B65H 75/366 242/588.2
2011/0220754 A1 * 9/2011 Merten ..... H02G 11/02 242/400.1
2012/0014744 A1 * 1/2012 Lin ..... F16C 11/10 403/91
2014/0061273 A1 * 3/2014 Bullivant ..... A45F 3/04 224/576
2015/0305462 A1 * 10/2015 Rothbaum ..... H04M 1/15 224/575
2018/0070705 A1 * 3/2018 Jose ..... B65H 75/4434
2018/0192824 A1 * 7/2018 Mogil ..... A45C 3/001
2020/0060222 A1 * 2/2020 Watson ..... A45F 3/04
2020/0170367 A1 * 6/2020 Selhi ..... A47B 61/003
2021/0253391 A1 * 8/2021 Willingham ..... A45F 3/04

* cited by examiner

COILER WITH ACCOMPANYING ATTACHMENTS AND BAG

CROSS-REFERENCE TO RELATED APPLICATION

This application claims the benefit of Provisional Patent Application Ser. No. 62/827,116, originally filed on Mar. 31, 2019.

BACKGROUND

1. Field of the Invention

There are numerous problems with tools in use to pack and coil ropes thus far, including but not limited to those used in activities such as rock climbing. An embodiment described herein satisfies a great need for a transportable device that allows ropes and other materials to be coiled effectively that is not currently addressed with prior art. It also allows for the convenient transportation of a multitude of other tools and functions.

2. Background Information

Some bags for transporting items have been in use to assist users in packing, storing, and moving items. There are numerous limitations with bags in use thus far, and, among other issues, there is a great need for bag that allows ropes to be coiled effectively while also transporting tools and other items in a user-friendly and time-efficient manner. An embodiment described herein may have uses in numerous settings, including but not limited to rock climbing, outdoors activities, and various other settings as well.

SUMMARY

In accordance with a description of an embodiment herein, a coiler on which a rope, extension cord, and/or other materials may be coiled and allows for additional tools to be included and/or coupled to it to serve numerous functions. Such a coiling device may be coupled with a bag and/or other device.

BRIEF DESCRIPTION OF DRAWINGS

Other characteristics and advantages of some embodiments described herein will become apparent from the following description, given by way of non-limiting examples, with reference to the annexed drawings, in which:

FIG. 6A shows a 36 bag with a water bottle holder on a strap and a hook for a solar panel with a portable solar panel hanging from the hook.

REFERENCE NUMERALS OF DRAWINGS

| | | | |
|---|---|---|---|
| 10 | coil guide | 12 | body of coil guide |
| 14 | stopper of coil guide | 16 | rope pinch |
| 18 | hinge | 20 | end attachment |
| 22 | coil guide clamp | 24 | quickdraw setter/remover attachment |
| 26 | brush clip | 28 | bag attachment |
| 30 | locking hinge | 32 | broomstick cap |
| 34 | coil guide mount | 36 | bag |
| 38 | bag opening | | |

DESCRIPTION

In some embodiments, a 10 coil guide may comprise a 12 body of coil guide and a 14 stopper of coil guide, with the 14 stopper of coil guide coupling with the 12 body of coil guide by a movable coupling. Any movable coupling that couples a 12 body of coil guide and 14 stopper of coil guide may comprise one or more protruding components of either a 12 body of coil guide or 14 stopper of coil guide entering into one or more recessed holes in the other of the 12 body of coil guide or 14 stopper of coil guide. Alternatively, in some embodiments a 12 body of coil guide and 14 stopper of coil guide may couple by any means that two components may be coupled.

Figure 1A:
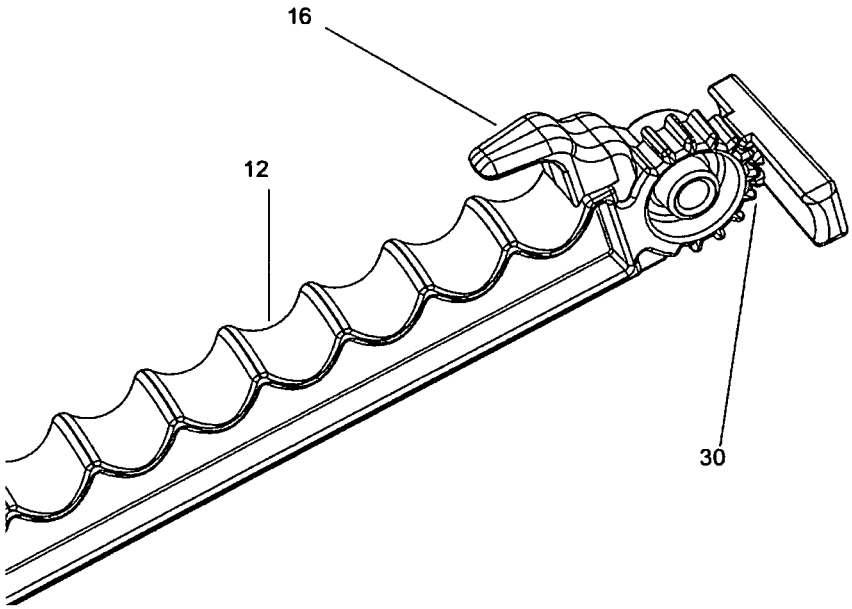
FIGS. 1A to 1E show a 12 body of coil guide and 14 stopper of coil guide, as well as a 30 locking hinge.
Figure 1B:
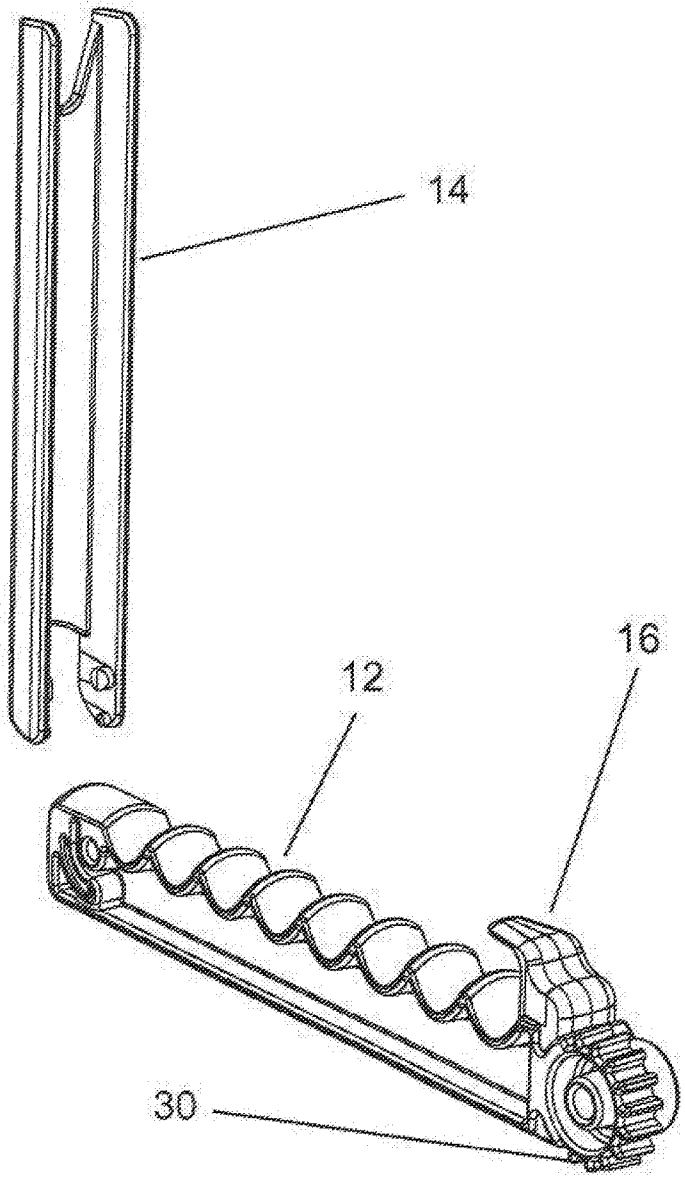
Figure 1C:
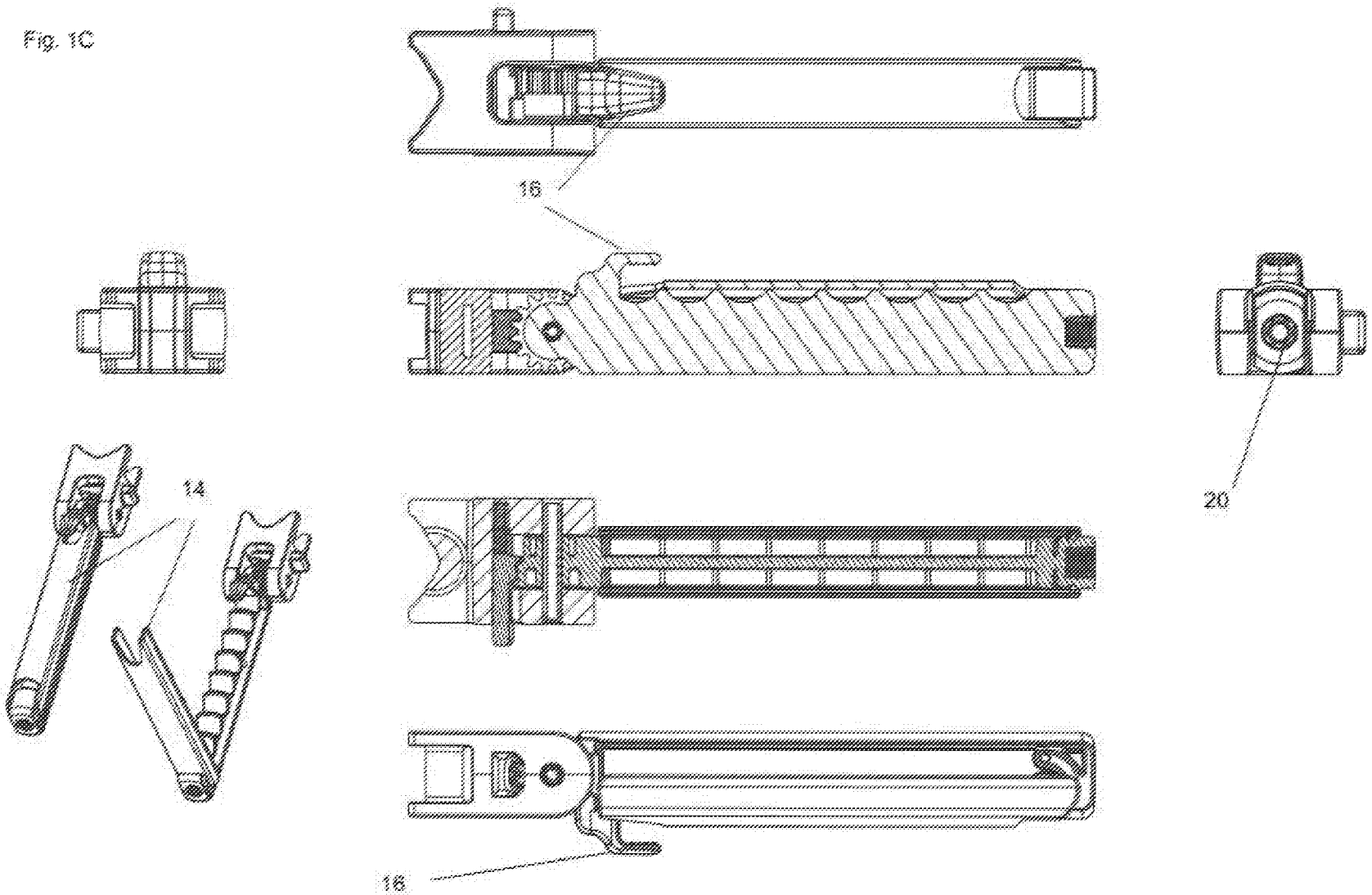
Figure 1D:
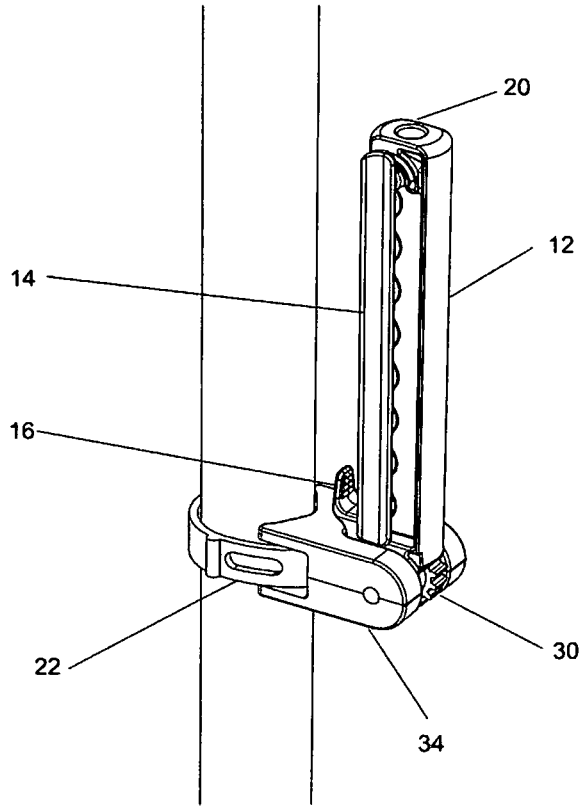
Figure 1E:
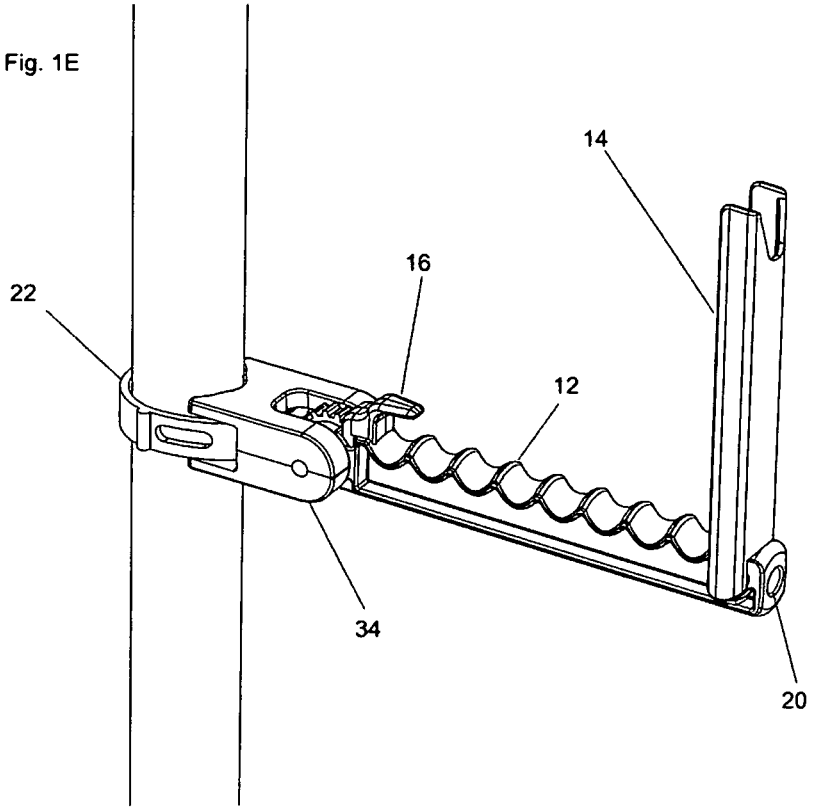

In some embodiments, a 12 body of coil guide may comprise a 20 end attachment, with such 20 end attachment comprising a recessed hole with threading as depicted by way of a non-limiting example in FIGS. 1C to 1E. Alternatively, in some embodiments a 20 end attachment may comprise any means by which two or more components may be coupled.

In some embodiments, a 10 coil guide and/or 14 stopper of coil guide may be comprised of plastic. In some embodiments, a 12 body of coil guide may be 6 inches long and be a cylindrical shape with at least a portion of it having a grooved surface. All or none of a 14 stopper of coil guide may fit on and/or around a 12 cover of coil guide. Alternatively, in some embodiments a 12 cover of coil guide and 14 stopper of coil guide may be comprised of various plasticized materials, fiberglass, any material which may be comprised of any proportion of carbon fiber-based material, any metallic material, aluminum, wood, rubber, vinyl, or any variation or combination of these or other materials. Some embodiments of a 10 coil guide and/or any 12 body of coil guide and/or a 14 stopper of coil guide may be comprised of different shapes, sizes, dimensions, thicknesses, and/or portions of thickness. In some embodiments, no portion of a 14 stopper of coil guide may fit on and/or around a 12 body of coil guide.

In some embodiments, a 12 body of coil guide and/or 14 stopper of coil guide may comprise one or more corresponding bumps and holes, such that a bump on one such component fits into a hole on the opposite component, to allow a 12 body of coil guide to hold in place in various positions when so coupled with a 14 stopper of coil guide. Alternatively, in some embodiments such bumps and/or holes may be absent.

In some embodiments, a 30 locking hinge, fastener, and/or other movable coupling may couple a 12 body of coil guide to a 34 coil guide mount. A 30 locking hinge, fastener, and/or other movable coupling may comprise an axle on which a 10 coil guide rotates, and an embodiment comprising a grooved surface, with said grooved surface comprised to interact with an opposing grooved surface. A 12 body of coil guide may comprise one of the grooved surfaces and a button may comprise another of the grooved surfaces, with each of these grooved surfaces interacting as demonstrated by way of non-limiting examples in FIGS. 1A and 1C. In some embodiments, the button may interact with a spring or other resistance mechanism that extends the button outward. Dimensions of the grooved surfaces on the 12 body of coil guide and the button may be such that when the button is pushed in, the grooved surfaces do not come into contact thereby allowing the 12 coil guide to rotate along the axle. However, when the button is not pushed in and the grooved surfaces of the 12 body of coil guide and button do interact, this may have the effect of locking the hinge, fastener, and/or other movable coupling in place such that the 12 body of coil guide cannot rotate on the axle. Given the number and/or location of grooves on the 12 body of coil guide and/or button, the 30 locking hinge, fastener, and/or other movable coupling may be able to be locked with the 12 body of coil guide held in any number of positions. Alternatively, a 30 locking hinge, fastener, and/or other movable coupling may comprise other mechanisms and/or may utilize other means to hold a 12 body of coil guide in various positions.

An axle in a 30 locking hinge, fastener, and/or other movable coupling system may be coupled to a 34 coil guide mount, such that a 12 body of coil guide that rotates around such axle may be coupled with that 34 coil guide mount. In some embodiments, a button is comprised of metal, with a spring and/or similar expanding mechanism that pushes the button outward, but which can be pushed inward by a user and be of a size and have a resistance such that a user's thumb can push it inward. Alternatively, in some embodiments, a button may be comprised of any material including but not limited to any various plasticized materials, fiberglass, any metal and/or metallic material, any material which may be comprised of any proportion of carbon fiber-based material, wood, rubber, vinyl, and/or any variation and/or combination of these and/or other materials, and/or may comprise of any shape and/or dimension. In some embodiments, grooved surfaces may be comprised of plastic and grooves may be approximately 0.01 inches from trough to crest and 0.04 inches apart from one crest to another. Alternatively, in some embodiments, a grooved surface may be comprised of any material including but not limited to any various plasticized materials, fiberglass, any metal and/or metallic material, any material which may be comprised of any proportion of carbon fiber-based material, wood, rubber, vinyl, and/or any variation and/or combination of these and/or other materials, and/or may comprise of any shape and/or dimension. In some embodiments, an axle may be comprised of metal and be a cylinder shape with a length of 1.3 inches and a diameter of 0.2 inches. Alternatively, in some embodiments an axle may be comprised of any material including but not limited to any various plasticized materials, fiberglass, any metal and/or metallic material, any material which may be comprised of any proportion of carbon fiber-based material, wood, rubber, vinyl, and/or any variation and/or combination of these and/or other materials, and/or may comprise of any shape and/or dimension.

In some embodiments, a 10 coil guide may comprise a 14 stopper of coil guide as illustrated by way of non-limiting examples in FIGS. 113 to 1E. In some embodiments, a 14 stopper of coil guide may comprise one or more arms wherein a 14 stopper of coil guide couples with a 12 body of coil guide by a movable coupling, a bridge coupling one or more such arms, and/or one or more such arms that abut against and/or come close to a brake bump protruding on a 12 body of coil guide which may limit the range of rotation of such 14 stopper of coil guide. In some embodiments, a 12 body of coil guide may be 5 inches long and a 14 stopper of coil guide may be 4.8 inches long, and both may be comprised of plastic. Alternatively, in some embodiments, a 14 stopper of coil guide may be comprised of aluminum or any metallic material and/or be coupled to an end of a 12 body of coil guide that is opposite to an end of a 12 body of coil guide that is proximal to a 34 mount of coil guide. A 14 stopper of coil guide may have varying thicknesses and may be shaped similarly to a 12 body of coil guide so as to fit on and/or around a 12 body of coil guide. Alternatively, in some embodiments a 14 stopper of coil guide may be comprised of any material including but not limited to any various plasticized materials, fiberglass, any metal and/or metallic material, any material which may be comprised of any proportion of carbon fiber-based material, wood, rubber, vinyl, and/or any variation and/or combination of these and/or other materials, and/or may couple elsewhere on a 12 body of coil guide and/or other component of an embodiment contemplated herein. In some embodiments, a 14 stopper of coil guide may be comprised of other structures, shapes, sizes, and/or dimensions. In some embodiments, a 14 stopper of coil guide may couple to a 12 body of coil guide by other means and/or may interact with a brake bump in other manners or not at all. In some embodiments, a brake bump may be absent.

In some embodiments, a 14 stopper of coil guide may rotate up and/or down, so as to abut against and/or come close to a 12 body of coil guide. In some embodiments, a 14 stopper of coil guide may help prevent whatever material is being coiled on 10 coil guides, whether rope, extension cords, or any other materials, from falling off the end of a 12 body of coil guide during and/or after the coiling process. In some embodiments, a 14 stopper of coil guide may lock in an open position of any degree or number of varying degrees and/or lock in a closed position such that it requires additional effort to adjust the position of such 14 stopper of coil guide. Alternatively, in some embodiments a 14 stopper of coil guide may have no locking mechanism such that it rotates throughout its entire permitted range of motion without requiring any additional effort to rotate past a given point that is permitted by such embodiment.

In some embodiments, a 10 coil guide and/or any other component of an embodiment described herein may comprise a 16 rope pinch as illustrated by way of non-limiting examples in FIGS. 1A to 1E. A 16 rope pinch may comprise a cutout with two or more opposing sides that vary in distance apart from one another along a length of said opposing sides such that some of portions of said opposing sides are closer than other portions of said opposing sides, a slit on an edge of said cover of coil guide inside which material may fit, and a clamp comprising a fulcrum and two levers with an end of each of the two levers of said clamp being held together unless pressure is exerted on an opposite end of one or more of said levers of said clamp. Alternatively, a 16 rope pinch may comprise any mechanism by which any portion of a rope may be held in place while a rope is coiled. In some embodiments, a 16 rope pinch may be comprised of plastic and have dimensions such that ropes with a diameter of 9.5 millimeters to 11.5 millimeters are held tightly in said 16 rope pinch. Alternatively, a 16 rope pinch may comprise any material including but not limited to any various plasticized materials, fiberglass, any metal and/or metallic material, any material which may be comprised of any proportion of carbon fiber-based material, wood, rubber, vinyl, and/or any variation and/or combination of these and/or other materials, and/or may comprise of any shape and/or dimension and/or be comprised to hold ropes, cords, wires, and/or any other material with any other dimensions.

Figure 2A:
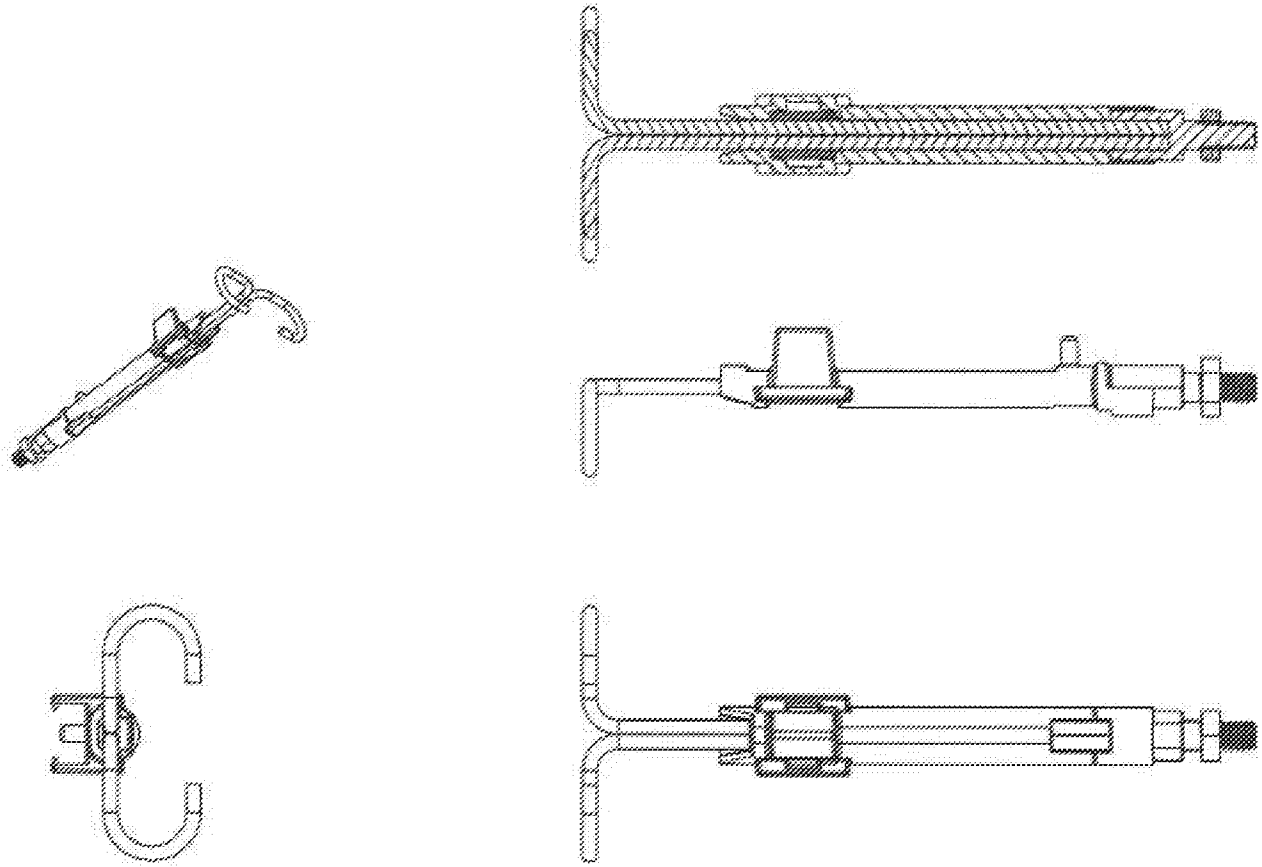
FIG. 2A shows a 26 brush clip that may couple with a 20 end attachment.
Figure 2B:
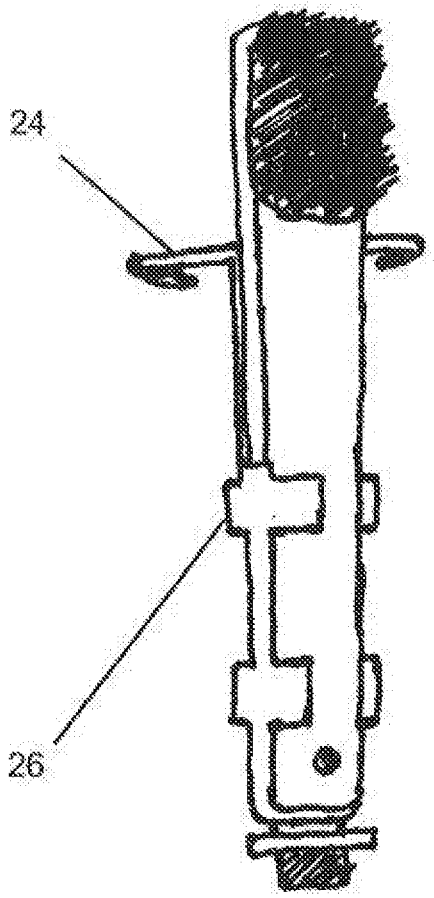
FIG. 2B shows a 26 brush clip with a brush coupled to it.

In some embodiments, a 26 brush clip may couple with a 20 end attachment. An embodiment of a 26 brush clip is illustrated by way of non-limiting examples in FIGS. 2A and 2B. An embodiment of a 26 brush clip may comprise threading at its base that corresponds with threading in a 20 end attachment. In some embodiments, a 26 brush clip may comprise one or more pairs of arms extending from the body of the brush clip, and/or one or more embodiment extending from the top of the body of brush clip comprising a helical shape. A 26 brush clip may be used to hold a brush in place via arms and peg, and also comprise a quickdraw setter/remover comprising a helical shape which may fit around a carabiner of a quickdraw. A 26 brush clip may comprise a sleeve that may hold together the embodiments extending from the top of the body of brush clip and forming a helical shape, so that those embodiments do not spread too far apart when wrapping around a carabiner. Alternatively, a 26 brush clip may comprise other mechanisms, materials, and/or dimensions. In some embodiments, the threading in a 26 brush clip may be comprised of metal that is coupled with a plastic piece comprising arms and a peg, with the sleeve comprising of metal. In addition, the wiring may be comprised of metal that has some flexibility such that it can expand to fit around a carabiner but contract when pushed beyond the widest portion of said carabiner. In some embodiments, the plastic portion of a 26 brush clip may be 3.75 inches long and the one or more wires may be 5 inches long. Alternatively, some embodiments of a 26 brush clip may be comprised of any material including but not limited to any various plasticized materials, fiberglass, any metal and/or metallic material, any material which may be comprised of any proportion of carbon fiber-based material, wood, rubber, vinyl, and/or any variation and/or combination of these and/or other materials, and/or may comprise of any shape and/or dimension.

Figure 3:
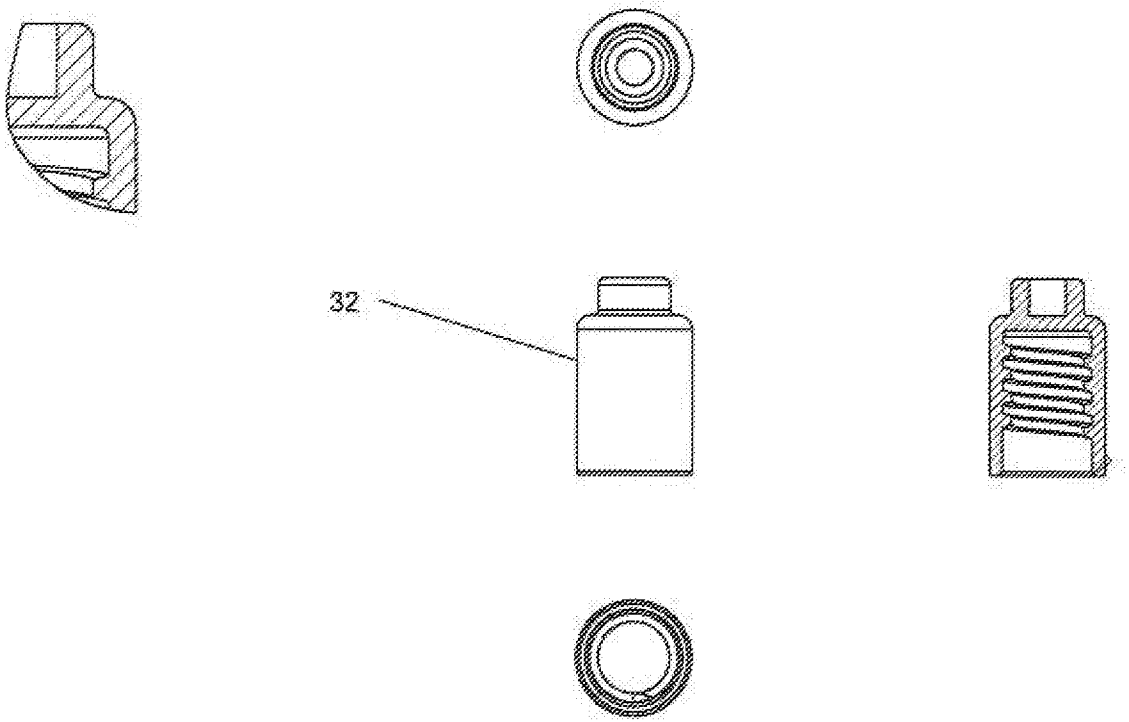
FIG. 3 shows a 32 broomstick cap.

In some embodiments, a 26 brush clip may couple with a 32 broomstick attachment. In some embodiments, a 32 broomstick attachment may comprise two ends with threading, with one end having threading that fits the 26 brush clip and the second end containing standard three-quarter inch threading, such that a 32 broomstick attachment can couple a 26 brush clip to a broomstick or similar device to allow the tools coupled with the 26 brush clip to be used in places that require a longer reach. Alternatively, a 32 broomstick attachment may comprise threading of other sizes and/or may comprise other mechanisms for attaching one or more objects to it. A non-limiting illustration of an embodiment of a 32 broomstick attachment is shown in FIG. 3. Some embodiments of a 32 broomstick attachment may be comprised of plastic. In some embodiments, a 32 broomstick attachment may comprise a cylinder shape and be 1.5 inches long with a diameter of three-quarters of an inch. Alternatively, some embodiments may be comprised of any material including but not limited to any various plasticized materials, fiberglass, any metal and/or metallic material, any material which may be comprised of any proportion of carbon fiber-based material, wood, rubber, vinyl, and/or any variation and/or combination of these and/or other materials, and/or may comprise of any shape and/or dimension.

Alternatively, some embodiments of a 32 broomstick attachment may be comprised of various plasticized materials, fiberglass, any material which may be comprised of any proportion of carbon fiber-based material, any metallic material, aluminum, wood, rubber, vinyl, or any variation or combination of these or other materials. Some embodiments of a 32 broomstick attachment may be comprised of different shapes, sizes, dimensions, thicknesses, and/or portions of thickness.

In some embodiments, a 10 coil guide may couple with a 28 bag attachment. In some embodiments, a 28 bag attachment may be inside the 36 bag, such that if the bag is unzipped or opened through any other means, the 28 bag attachment coupled with one or more 10 coil guides can be available for use as shown by a non-limiting example in FIG. 4. Alternatively, in other embodiments, a 28 bag attachment may be comprised of other configurations and located elsewhere on, in, and/or around a 36 bag.

Figure 4C:
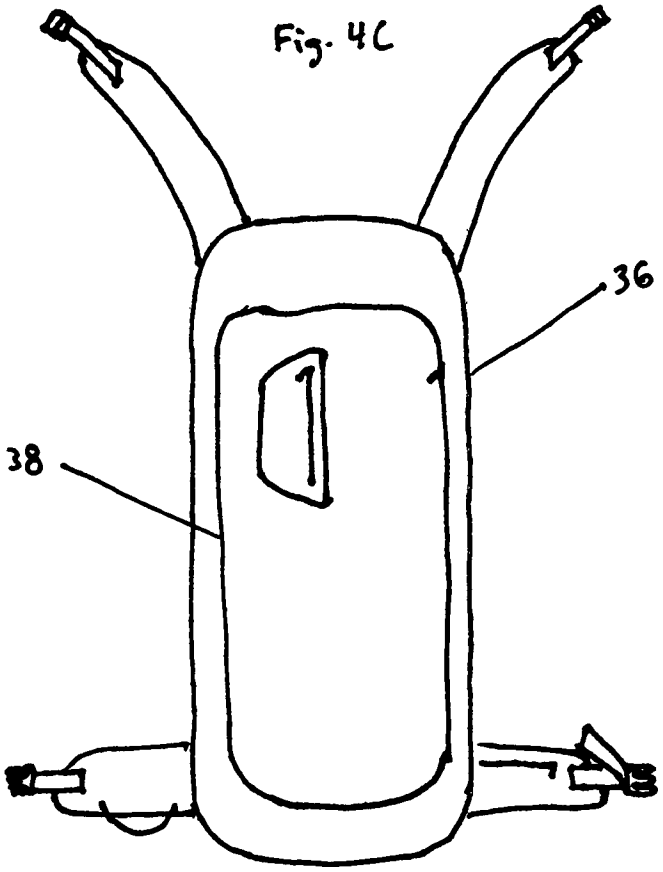
FIGS. 4A through 4E show a 36 bag, with 4E showing embodiments with 28 bag attachments that couple 10 coil guides to the inside of said 36 bag, and that may be accessible though a 38 bag opening.
Figure 4B:
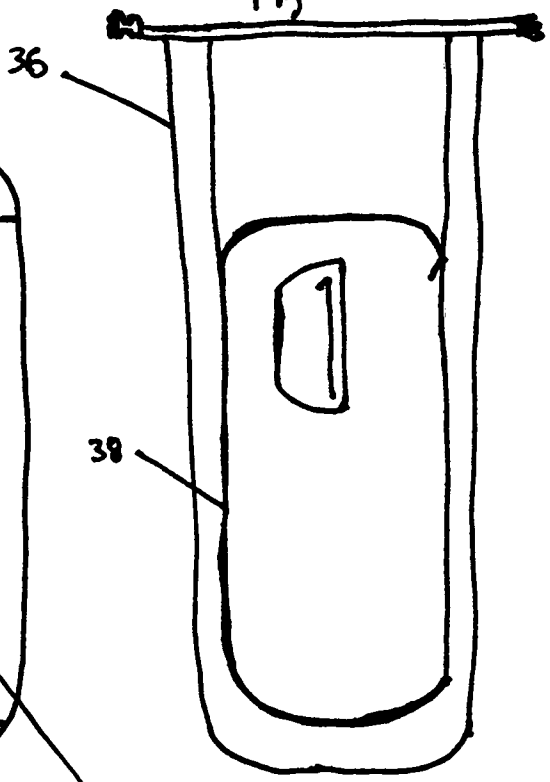
Figure 4A:
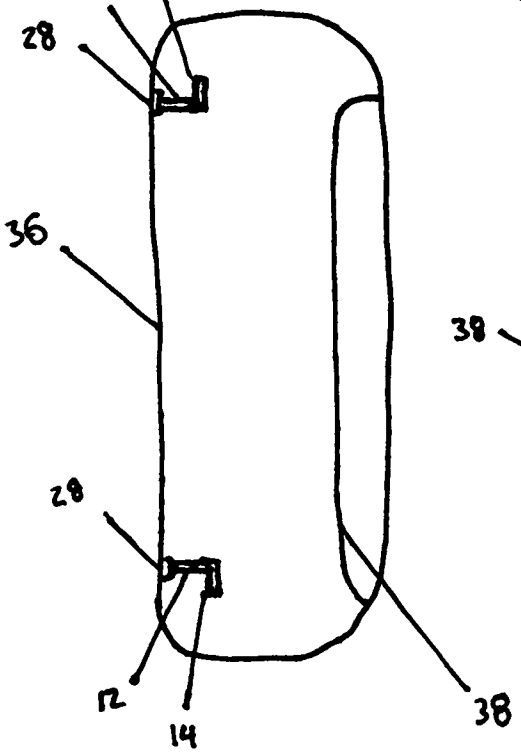
Figures 4D, 4E:
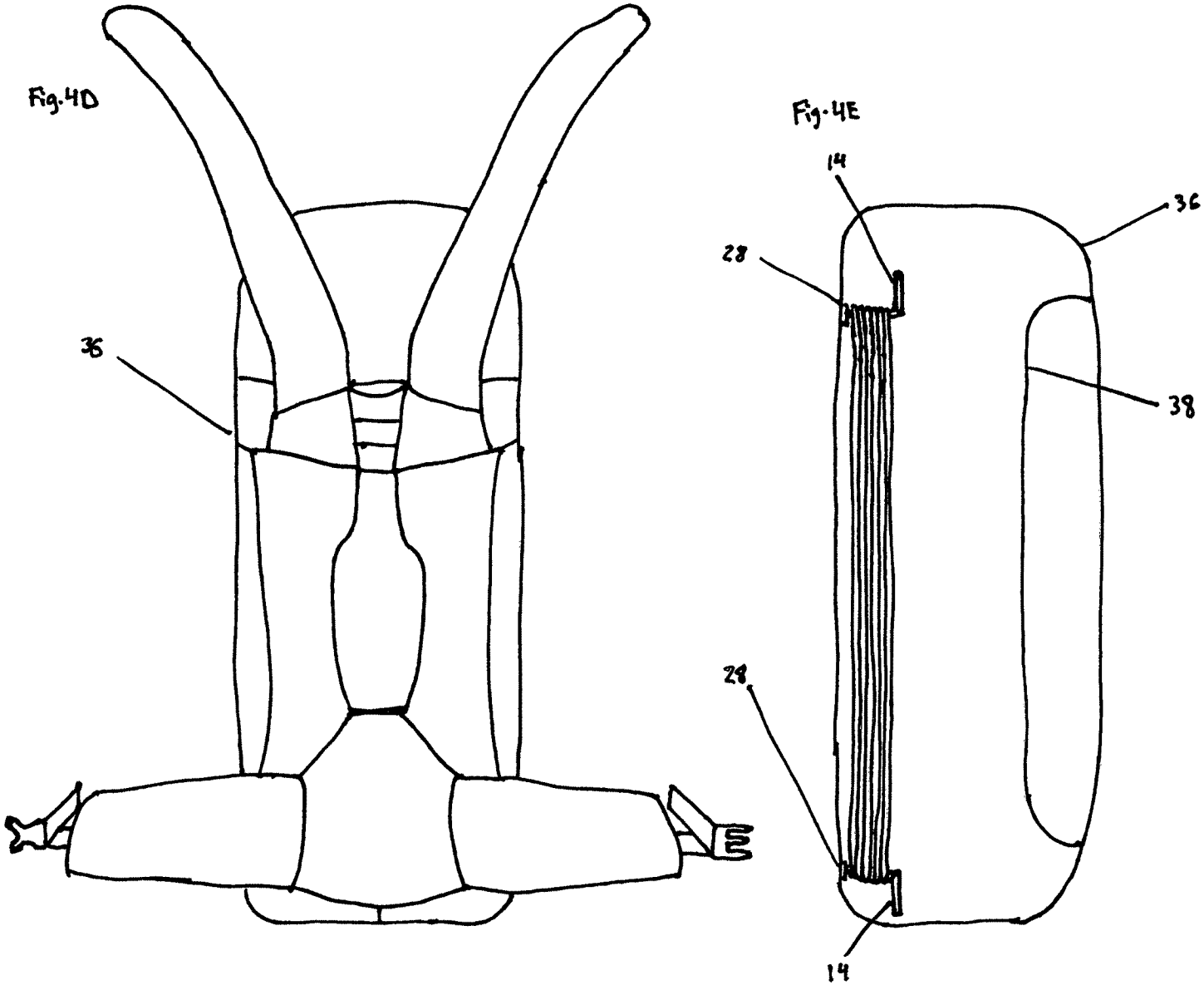
Figure 4F:
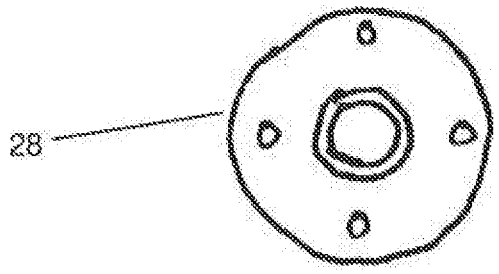
FIGS. 4F through 4H show a 28 bag attachment, with FIG. 4H showing a 10 coil guide coupled with said 28 bag attachment by a 34 coil guide mount and a 22 coil guide clamp.
Figure 4G:
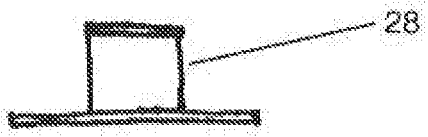
Figure 4H:
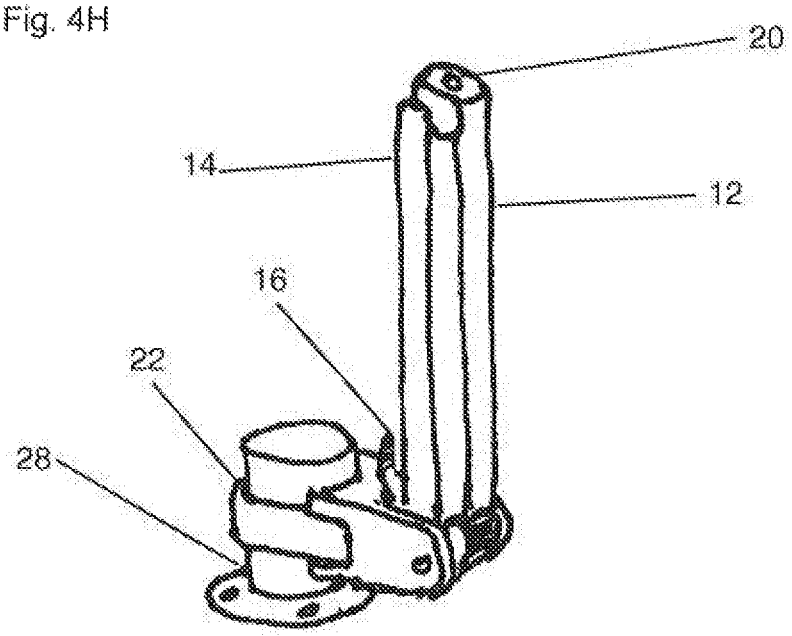
Figure 4I:
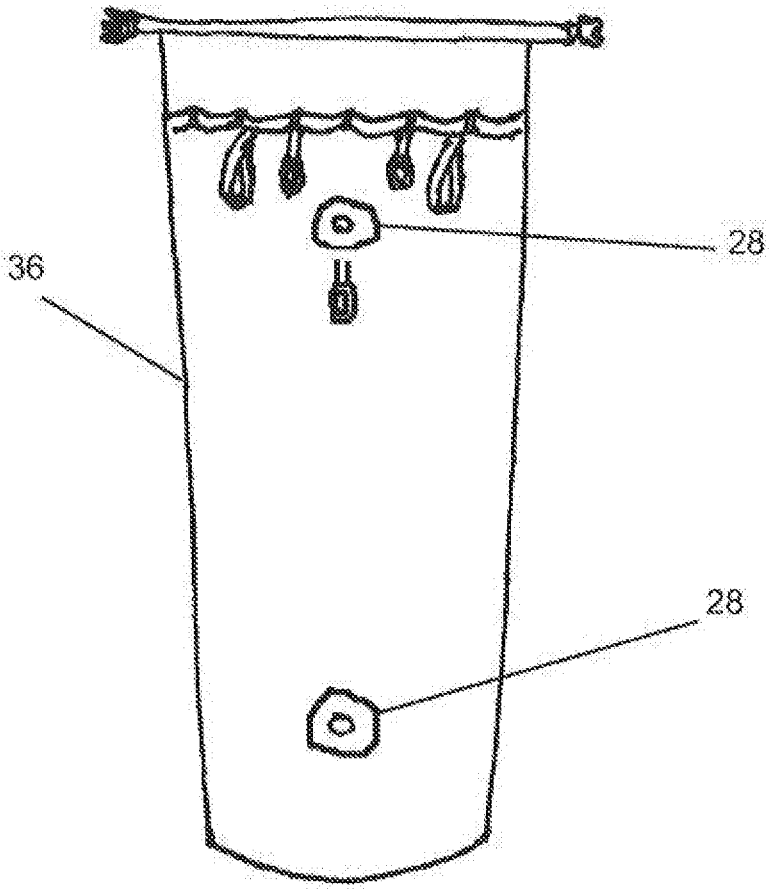
FIG. 4I shows the inside of a 36 bag with 28 bag attachments included and loops, clips, and a daisy chain or strap coupled with the bag.

In some embodiments, a 28 bag attachment may comprise a circular shape with a center that protrudes outward from the base of the 28 bag attachment as illustrated by way of non-limiting examples in FIGS. 4F-4G. In some embodiments, a 22 coil guide clamp may couple with the 28 bag attachment. Additionally, in some embodiments a 28 bag attachment may contain one or more holes on its base such that screws, rivets, and/or any other means of coupling may be used to couple said 28 bag attachment to said 36 bag. In some embodiments, a 28 bag attachment may comprise a width of 4 inches and the protruding portion may extend two inches from the base and have a width of one inch. In some embodiments, a 28 bag attachment may be comprised of plastic. Alternatively, in some embodiments a 28 bag attachment may be comprised of various plasticized materials, fiberglass, any material which may be comprised of any proportion of carbon fiber-based material, any metallic material, aluminum, wood, rubber, vinyl, or any variation or combination of these or other materials. Some embodiments of a 28 bag attachment may be comprised of different shapes, sizes, dimensions, thicknesses, and/or portions of thickness. In some embodiments, a 36 bag may comprise a height of 28 inches when the top opening is closed and may be 35 inches tall when the top opening is opened and any flap or other piece of the 36 bag is extended upwards, and have a width of 13 inches. A 36 bag may be comprised of nylon. Alternatively, some embodiments of a 36 bag may be comprised of any material including but not limited to any various synthetic and/or nylon, mesh, canvas, cotton, wool, fleece, plasticized materials, fiberglass, any metal and/or metallic material, any material which may be comprised of any proportion of carbon fiber-based material, wood, rubber, vinyl, and/or any variation and/or combination of these and/or other materials, and/or may comprise of any shape and/or dimension.

In some embodiments, one or more 28 bag attachment may be coupled to the inside of a 36 bag, such that a user may open a 38 bag opening to access any 28 bag attachments. In some embodiments, a 38 bag attachment may comprise a zipper. Alternatively, in some embodiments, a bag attachment may be located elsewhere. In some embodiments, a 38 bag opening may comprise any mechanism other than a zipper.

Figure 6B:
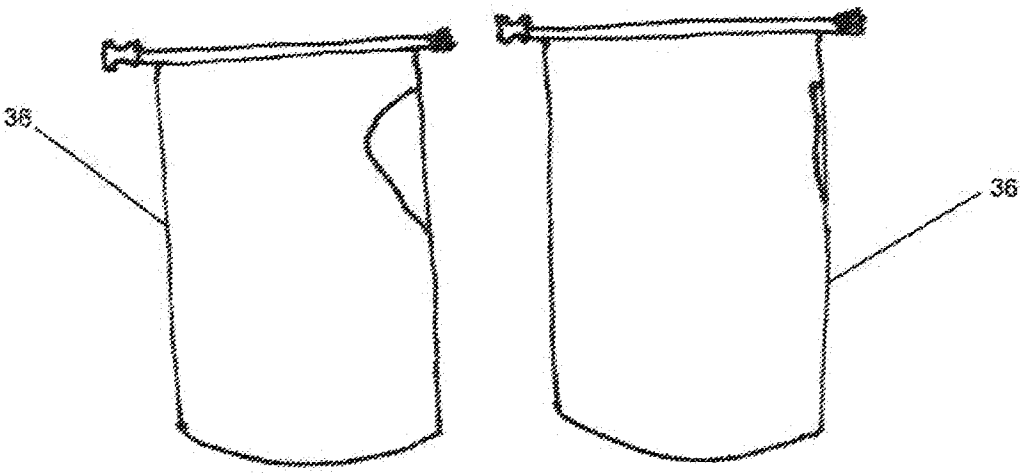
FIG. 6B shows a 36 bag with the inside of said 36 bag comprising a pocket that is collapsible, and contrasts the difference of a pocket not collapsed versus a pocket that is collapsed.

In some embodiments, a 36 bag may also comprise hooks, loops, straps, daisy chains, and/or other devices and/or mechanisms for carrying various tools, including but not limited to rock climbing tools and/or mechanisms that hold water. Such devices and/or mechanisms may comprise a sleeve on the bag which can hold a water bottle. FIG. 6A shows, by way of non-limiting example, an embodiment of a 36 bag comprising a water bottle holder on a strap. Some embodiments may comprise a water bottle holder that is collapsible. Alternatively, some embodiments may comprise a water bottle holder that is not collapsible. Additionally, some embodiments may comprise devices and/or mechanisms such as hooks, loops, and/or other devices and/or mechanisms that hold a water bladder, and contain holes to allow a hose of a water bladder to extend outside a 36 bag, and/or hooks that hold a hose in place. Alternatively, some embodiments of a 36 bag may comprise no such devices and/or mechanisms.

Some embodiments of a 36 bag may comprise pockets comprising breathable fabric such as mesh or netting and/or others may comprise pockets comprising less breathable fabric. Some embodiments may comprise a heavier fabric for an external pocket cover with a mesh cover underneath, such that the heavier fabric and/or mesh fabric can be used on said pocket, such that said pockets have multiple layers of fabric around all or any portion of said pocket. Alternatively, in some embodiments a pocket may have only one layer of fabric or multiple layers of fabric comprising different fabrics than described above, and/or may comprise materials other than fabric.

Some embodiments of a 36 bag may comprise zippers to collapse pockets such that pockets can be zipped up against the wall of the 36 bag to allow more room inside of the 36 bag to carry contents. An embodiment of a 36 bag with such a collapsible pocket is demonstrated by way of a non-limiting example in FIG. 6B. Alternatively, some embodiments of a 36 bag may comprise snaps and/or any other means to collapse said pockets. Some embodiments may not comprise means to collapse any pockets.

Some embodiments of a 36 bag may comprise one or more pockets with insulating material, such that food items in said one or more pockets may be kept at a relatively stable temperature for a period of time. Alternatively, some embodiments of a 36 bag may not comprise pockets with one or more pockets containing insulating material.

Some embodiments of a 36 bag may comprise a mechanism to transport a solar panel, including but not limited to a clear plastic sleeve, a mesh pocket, corresponding snaps, clip, hook, and/or any other mechanism that can be used to couple a transportable solar panel to a 36 bag. Such solar panel may be used to provide power and/or recharge various electronic devices being transported in such 36 bag, including but not limited to cellular phones, cameras, and various other such electronic devices. Some embodiments of a 36 bag may have hooks and/or loops on the outside of said 36 bag that can be used to help transport items other than solar panels. An embodiment of a 36 bag with a solar panel comprised to a hook is illustrated by way of non-limiting example in FIG. 6A. Alternatively, some embodiments of a 36 bag may comprise no such hooks and/or loops on the outside of said 36 bag and/or may comprise one or more hooks and/or loops located far from any pocket.

Some embodiments of a 36 bag may comprise a flap of fabric that can be pulled out and set on the ground and utilized to keep a climbing rope off of the ground. Such fabric may be comprised of a tarp, any waterproof fabric, and/or any other fabric and be square shaped and have dimensions of 5 feet wide by 5 feet long. Such fabric may fold up and/or contain snaps to assist with folding and holding it together. Alternatively, in some embodiments, the fabric may not fold up nor use snaps to assist with folding and holding it together and the flap may be comprised of any material and/or share and/or dimensions. The flap may be attached to the 36 bag. Alternatively, in some embodiments, the flap may not be attached to a 36 bag.

Alternatively, some embodiments of a 36 bag with a 28 bag attachment may contain any combination of the above described embodiments or none of them.

Figure 5:
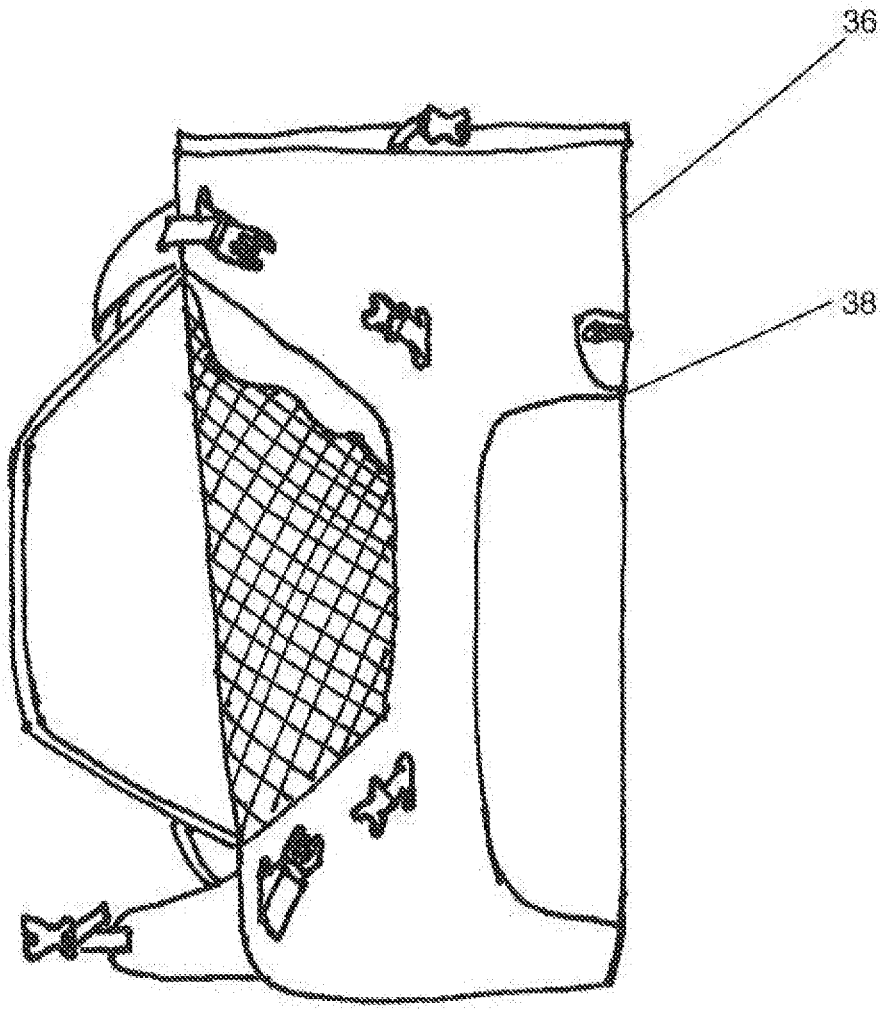
FIG. 5 shows a 36 bag with a side pocket that has one layer unzipped and open with a second layer comprised of mesh partially unzipped.
Figure 8A:
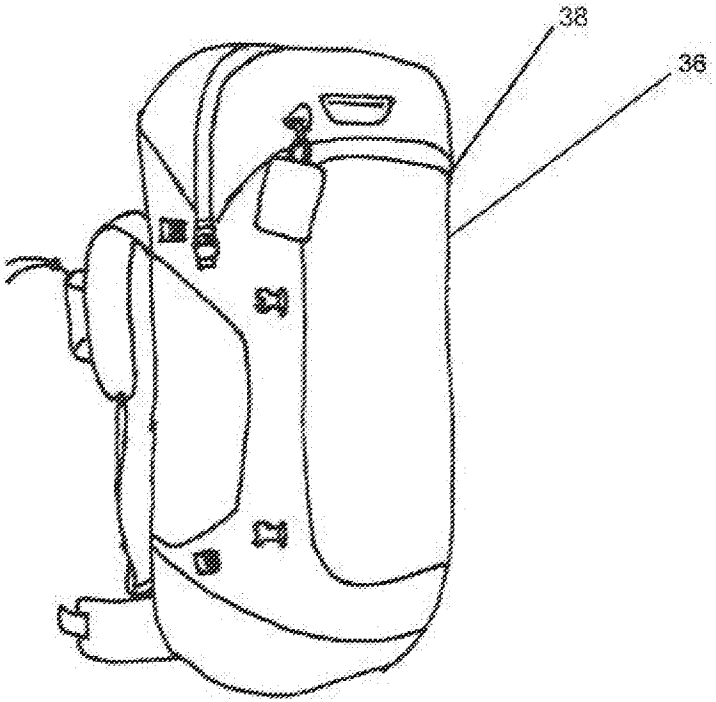

Some embodiments of a 36 bag may comprise straps with corresponding buckles, such that when said buckles are fastened together and said straps are pulled tight, the straps may constrict the bag to hold the contents inside of the 36 bag tighter. Said straps and buckles are illustrated by way of a non-limiting example in FIG. 5. Said straps and buckles may be located anywhere on or in a 36 bag. Said straps may be comprised of fabric and said buckles may be comprised of plastic. Alternatively, some embodiments of said straps and buckles may be comprised of other materials. Some embodiments of a 36 bag may contain no such straps and buckles.

Some embodiments of a 36 bag may comprise a waist strap, with said waist strap comprising pockets, loops, and/or hooks to assist in transporting items. Some embodiments with pockets may be comprised of waterproof material to keep items inside said pockets dry. Alternatively, some embodiments of a 36 bag may contain no such pockets, loops, and/or hooks. Additionally, some embodiments of a 36 bag that contain pockets may be comprised of other materials that may or may not be waterproof.

Although the description above contains many specificities, these should not be construed as limiting in scope in any way but as merely providing illustrations of some possibilities of preferred embodiments of the combination of materials, components, functions, and/or uses contemplated herein. Any and all components described and/or alluded to herein may be comprised of a number of different materials and come in a number of different sizes, shapes, and dimensions and still adhere to the specifications set forth herein.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Figures, diagrams, and drawings have been provided to illustrate non-limiting examples of potential embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. A coiling device comprising: (a) a stopper of coil guide configured to be coupled to a body of coil guide with a movable coupling; and (b) a locking hinge coupling said body of coil guide to a coil guide mount, with said locking hinge comprising an axle on which a body of coil guide rotates, and with the body of coil guide comprising a grooved surface that interacts with an opposing grooved surface on a button lock.

2. The coiling device in accordance with claim 1, wherein said body of coil guide further comprises a grooved surface.

3. The coiling device in accordance with claim 1, further comprising one or more of the following: a cutout with two or more opposing sides that vary in distance apart along the length of said cutout side such that some portions of said opposing cutout sides are closer than other portions of said opposing cutout sides, a slit on an edge in which material may fit inside, and a clamp comprising a fulcrum and two levers with an end of each of the two levers of said clamp being held together unless pressure is exerted on the opposite end of one or more lever of said clamp.

4. The coiling device in accordance with claim 1, further comprising a bag attachment to which a coil guide clamp couples, with said hag attachment coupling to a bag or other structure.

5. The coiling device in accordance with claim 1, further comprising one or more portion of one or more of said stopper of coil and said body of coil guide comprising a brake bump or recess that interacts with an opposing brake bump or recess on the alternative of stopper of coil guide and said body of coil guide, which may impact the range of said stopper of coil guide's rotation.

6. The coiling device in accordance with claim 1, further comprising means to couple in combination with one or more of the following attachment items: a brush clip, brush attachment, and quickdraw setter/remover.

7. The coiling device in accordance with claim 1, further comprising a brush clip that may couple with an end attachment of the body of coil guide, with said brush clip comprising a quickdraw setter/remover attachment with a rod extending away from the attachment location and forming a helical shape that fits partially or completely around a carabiner of a quickdraw with means to couple with a broomstick cap.

8. The coiling device in accordance with claim 7, with said body of coil guide having one or more mechanism that allows said brush clip to couple with said body of coil guide, which may coupe with a bag attachment in a hag and/or attach to other objects such as a staff.

9. The coiling device in accordance with claim 7, further comprising one or more pairs of arms extending from the body of the brush clip, and/or a peg that may facilitate coupling a brush with the brush clip.

10. A combination bag and coiling device comprising: (a) one or more first pockets that contain insulating materials; (b) one or more second pockets with one or more sides that have one or more layers of materials that close the one or more second pockets, with the one or more layers comprising a breathable mesh material; (c) a stopper of coil guide coupled to a body of coil guide with a movable coupling; and (d) a locking hinge coupling said body of coil guide to a coil guide mount, with said locking hinge comprising an axle on which said body of coil guide rotates, with said body of coil guide comprising a grooved surface that interacts with an opposing grooved surface on a button lock.

11. The combination bag and coiling device in accordance with claim 10, with one or more coil guide attachments coupled with said bag, with said one or more coil guide attachments comprising a surface that is affixed to the bag and with which a coil guide clamp may couple.

12. The combination bag and coiling device in accordance with claim 10, with said bag comprising one or more of the following coupled with one or more portions of said bag: straps, daisy chains, loops, hooks, and other devices and mechanisms on or with which took and other gear may fasten, attach, or couple.

13. The combination bag and coiling device in accordance with claim 10, with said bag comprising mechanisms that allow pockets of said back to be held in a flattened shape by one or more zippers, snaps, or other mechanisms that couple fabric.

14. The combination bag and coiling device in accordance with claim 10, with said bag comprising a water bottle holder coupled with said bag.

15. The combination bag and coiling device in accordance with claim 10, with said hag comprising hooks and/or loops inside the bag to hold a water bladder and a hole allowing a hose from said water bladder to extend outside the hag, with hooks and/or loops coupled with the bag to hold said hose in place.

16. The combination bag and coiling device in accordance with claim 10, with said bag comprising one or more mechanisms to hold one or more solar panels in or on the bag, such that said one or more solar panels may receive sunlight, allowing said one or more solar panels to be plugged into an electronic device to provide electricity and/or charge battery.

17. The combination bag and coiling device in accordance with claim 10, with said bag comprising straps and buckles configured such that when fastened and tightened, the straps and buckles may constrict the bag to hold contents of said bag tighter.

18. The combination bag and coiling device in accordance with claim 10, with said bag comprising a waist strap with pockets to hold items.

19. The combination bag and coiling device in accordance with claim 10, with said bag comprising hooks and/or loops on outside of bag on which items can be attached.

20. The combination bag and coiling device in accordance with claim 10, with said bag comprising a tarp that that can fold up inside or on the bag.

* * * * *